US009067127B2

(12) United States Patent
Clark

(10) Patent No.: US 9,067,127 B2
(45) Date of Patent: Jun. 30, 2015

(54) LIGHT EMITTING TOYS AND LIGHT ACTIVATED TARGETS

(71) Applicant: Randy Wayne Clark, Strathmore, CA (US)

(72) Inventor: Randy Wayne Clark, Strathmore, CA (US)

( * ) Notice: Subject to any disclaimer, the term of this patent is extended or adjusted under 35 U.S.C. 154(b) by 0 days.

(21) Appl. No.: 13/740,222

(22) Filed: Jan. 13, 2013

(65) Prior Publication Data

US 2013/0184085 A1 Jul. 18, 2013

Related U.S. Application Data

(60) Provisional application No. 61/586,122, filed on Jan. 13, 2012.

(51) Int. Cl.

| | |
|---|---|
| ***A63H 33/22*** | (2006.01) |
| ***A63F 9/02*** | (2006.01) |
| ***F41A 33/02*** | (2006.01) |
| *A63F 9/24* | (2006.01) |

(52) U.S. Cl.

CPC ..... *A63F 9/0291* (2013.01); *A63F 9/0252* (2013.01); *F41A 33/02* (2013.01); *A63F 2009/0269* (2013.01); *A63F 2009/0282* (2013.01); *A63F 2009/2444* (2013.01); *A63F 2009/2454* (2013.01); *A63F 2250/426* (2013.01); *A63F 2250/49* (2013.01); *A63F 2250/491* (2013.01); *A63F 2250/495* (2013.01); *A63F 2250/497* (2013.01)

(58) Field of Classification Search

USPC ..... 463/56

See application file for complete search history.

(56) References Cited

U.S. PATENT DOCUMENTS

| | | | | | |
|---|---|---|---|---|---|
| 2,236,390 | A | * | 3/1941 | Wood et al. | 463/52 |
| 4,205,846 | A | | 6/1980 | Levine | |
| 4,556,391 | A | | 12/1985 | Tardivel et al. | |
| 4,586,715 | A | * | 5/1986 | Scolari et al. | 463/50 |
| 4,590,381 | A | | 5/1986 | Mendelson | |
| 4,612,948 | A | | 9/1986 | Simpson | |
| 4,678,450 | A | * | 7/1987 | Scolari et al. | 446/405 |
| 4,708,817 | A | | 11/1987 | Dudnick | |
| 4,825,892 | A | | 5/1989 | Norman | |
| 5,021,931 | A | | 6/1991 | Matsui et al. | |
| 5,038,812 | A | | 8/1991 | Norman | |
| 5,229,531 | A | * | 7/1993 | Song | 42/58 |
| 5,270,100 | A | | 12/1993 | Giglio | |
| 5,307,253 | A | | 4/1994 | Jehn | |
| 5,415,151 | A | * | 5/1995 | Fusi et al. | 124/56 |
| 5,450,148 | A | | 9/1995 | Shu et al. | |
| 5,480,338 | A | | 1/1996 | Barthold | |
| 5,495,269 | A | | 2/1996 | Elrod et al. | |

(Continued)

*Primary Examiner* — Tramar Harper

(74) *Attorney, Agent, or Firm* — Martino Patent Law at the Law Offices of Sepehr Daghighian

(57) ABSTRACT

A glow-in-the-dark toy kit includes a light emitting device configured to be controlled by a first player. The light emitting device is configured to emit a wavelength of light around 405 nanometers from a light emitting diode powered by a power source. A light receiving device is associated with the light emitting device and configured to be worn by a second player. The light receiving device includes a phosphorescence layer reactive to the 405 nanometer wavelength of light. The devices are used in a dark environment allowing the 405 nanometer wavelength of light to react with the phosphorescence layer and display an imaginary or real impact when the first player uses the light emitting device to illuminate the light receiving device worn by the second player.

15 Claims, 8 Drawing Sheets

(56) References Cited

U.S. PATENT DOCUMENTS

| | | | | |
|---|---|---|---|---|
| 5,512,002 | A | 4/1996 | Lieberman | |
| 5,579,799 | A | 12/1996 | Zheng | |
| 5,788,359 | A | 8/1998 | Halsey et al. | |
| 5,938,308 | A | 8/1999 | Feldman et al. | |
| 6,006,357 | A | 12/1999 | Mead | |
| 6,022,126 | A | 2/2000 | Sekine et al. | |
| 6,168,853 | B1 | 1/2001 | Feng et al. | |
| 6,257,263 | B1 | 7/2001 | Brereton | |
| 6,325,086 | B1 | 12/2001 | Shinner et al. | |
| 6,371,144 | B1 | 4/2002 | Ragatz | |
| 6,585,388 | B2 | 7/2003 | Kim | |
| 6,604,946 | B2 | 8/2003 | Oakes | |
| 6,666,742 | B2 | 12/2003 | Koizumi | |
| 6,709,142 | B2 | 3/2004 | Gyori | |
| 6,892,397 | B2 | 5/2005 | Raz et al. | |
| 6,966,557 | B2 | 11/2005 | Kirk et al. | |
| 7,029,193 | B1 | 4/2006 | Chao | |
| 7,152,248 | B2 | 12/2006 | Ziemer | |
| 7,161,578 | B1 | 1/2007 | Schneider | |
| 7,249,431 | B1 | 7/2007 | Rose et al. | |
| 7,314,325 | B2 | 1/2008 | Chang et al. | |
| 7,401,937 | B2 | 7/2008 | Abas | |
| 7,445,550 | B2 | 11/2008 | Barney et al. | |
| 7,481,234 | B1 | 1/2009 | Gustafson et al. | |
| 7,500,917 | B2 | 3/2009 | Barney et al. | |
| 7,503,677 | B2 | 3/2009 | Morishita | |
| 7,793,673 | B2 | 9/2010 | Anello | |
| 7,819,544 | B2 | 10/2010 | Thompson et al. | |
| 7,846,028 | B2 | 12/2010 | Small et al. | |
| 7,871,175 | B1 | 1/2011 | Bacca | |
| 7,878,905 | B2 | 2/2011 | Weston et al. | |
| 7,900,619 | B1 | 3/2011 | Palmer et al. | |
| 8,100,540 | B2 | 1/2012 | Huebner | |
| 8,245,321 | B2 | 8/2012 | Ambrosio et al. | |
| 2002/0081939 | A1* | 6/2002 | Hornsby et al. | 446/268 |
| 2003/0027103 | A1 | 2/2003 | Preston et al. | |
| 2004/0087377 | A1 | 5/2004 | Liu | |
| 2005/0051203 | A1 | 3/2005 | McCully et al. | |
| 2005/0195591 | A1 | 9/2005 | Garcia et al. | |
| 2005/0227580 | A1* | 10/2005 | Zuloff | 446/473 |
| 2005/0260918 | A1* | 11/2005 | LaPointe | 446/47 |
| 2006/0150328 | A1 | 7/2006 | Nguyen | |
| 2006/0250787 | A1 | 11/2006 | Ho et al. | |
| 2007/0048065 | A1 | 3/2007 | Schmidt et al. | |
| 2007/0060013 | A1 | 3/2007 | Schmidt et al. | |
| 2007/0113358 | A1 | 5/2007 | Rabolt et al. | |
| 2007/0128972 | A1* | 6/2007 | Schmidt et al. | 446/219 |
| 2007/0256721 | A1 | 11/2007 | Spain | |
| 2009/0040195 | A1 | 2/2009 | Njolstad et al. | |
| 2009/0267895 | A1 | 10/2009 | Bunch | |
| 2010/0067232 | A1 | 3/2010 | Luo | |
| 2010/0245531 | A1* | 9/2010 | Grisolia et al. | 347/264 |
| 2010/0288321 | A1 | 11/2010 | Dwyer | |
| 2011/0081191 | A1 | 4/2011 | Monzo et al. | |

* cited by examiner

LIGHT EMITTING TOYS AND LIGHT ACTIVATED TARGETS

CROSS-REFERENCE TO RELATED APPLICATIONS

This non-provisional patent application claims priority to provisional application 61/586,122 filed on Jan. 13, 2012 the contents of which are fully incorporated herein with this reference.

FIELD OF THE INVENTION

The present invention generally relates to light emitting toys and light activated targets. More particularly, the present invention relates to a light emitting projectile or weapon with an embedded LED configured to illuminate a light receiving device that can be worn by an opposing player.

BACKGROUND OF THE INVENTION

Children have always loved to play with guns, swords, bows, arrows and other various fake weaponry. Toy weapons are toys that mimic real weapons, but are designed to be fun for children to play with and not dangerous. From a hand-carved wooden replica to factory-produced pop guns and cap guns, toy weapons have come in all sizes, prices and materials from wood to metal. Plastic guns have been around for decades which included various lights and sounds when the trigger was activated. More recently, a laser tag game included a gun which emitted various infrared beams that could be registered upon a target. Sometimes these targets were worn on or around the body and could register a sound or noise when a target was hit. However, these laser tag games required expensive electronics to sense the infrared beam and then produce a sound when hit.

One of the more interesting materials which has intrigued toy manufacturers is that found in materials which are generally described as "luminescent". Luminescent materials are often described as "glow-in-the-dark" materials due to their property of storing illuminating energy received from an external source and thereafter glowing or emitting a subdued light for an extended period of time. Various types of games and toy apparatus attempting to make use of the amusing and interesting properties of luminescent materials have been provided.

Phosphorescence is a specific type of photoluminescence related to fluorescence. Unlike fluorescence, a phosphorescent material does not immediately re-emit the radiation it absorbs. The slower time scales of the re-emission are associated with "forbidden" energy state transitions in quantum mechanics. As these transitions occur very slowly in certain materials, absorbed radiation may be re-emitted at a lower intensity for up to several hours after the original excitation. Commonly seen examples of phosphorescent materials are the glow-in-the-dark toys, paint, and clock dials that glow for some time after being charged with a bright light such as in any normal reading or room light. Typically the glowing then slowly fades out within minutes (or up to a few hours) in a dark room.

Many toys and products have incorporated phosphorescence materials. For instance, the inventor of this patent application has also invented a light activated doodler and associated electronics and accordingly the application of Ser. No. 13/654,422 filed on Oct. 18, 2012 is fully incorporated herein with this reference. However, there is always a need for something new when it comes to weaponry and other physically active play patterns. Accordingly, toy manufacturers are always looking for new and exciting ways to allow children to play with various guns, swords and bows and arrows while utilizing new technologies and methods which are safe and easy to use. Also, toy manufacturers are always looking at ways to reduce the manufacturing cost of such complicated toys such that the same enjoyment is obtained without the significant cost and complexity.

Therefore, there is a need for a new way to allow children to safely play with glow-in-the-dark toys. The present invention fulfills these needs and provides other related advantages.

SUMMARY OF THE INVENTION

An exemplary embodiment of the present invention includes a glow-in-the-dark toy kit. The kit includes a light emitting device configured to be controlled by a first player. The light emitting device is configured to emit a wavelength of light around 405 nanometers from a light emitting diode powered by a power source. A light receiving device is associated with the light emitting device and configured to be worn by a second player. The light receiving device includes a phosphorescence layer reactive to the 405 nanometer wavelength of light. The light emitting device and the light receiving device are used in a dark environment allowing the 405 nanometer wavelength of light to react with the phosphorescence layer and display an imaginary or real impact when the first player uses the light emitting device to illuminate the light receiving device worn by the second player.

In an exemplary embodiment, a second light emitting device may be configured to be controlled by the second player. A second light receiving device may be configured to be worn by the first player. The second light emitting device is configured to also emit a wavelength of light around 405 nanometers from a second light emitting diode powered by a second power source. The second light receiving device comprises a second phosphorescence layer reactive to the 405 nanometer wavelength of light.

In another exemplary embodiment, the light emitting device comprises a laser gun including a trigger configured to operatively control the light emitting diode. The laser gun is configured to project the 405 nanometer wavelength of light at least 10 feet.

In another exemplary embodiment, the light emitting device comprises a sword. The 405 nanometer wavelength of light from the light emitting diode is configured to react with phosphorescence layer when it is substantially adjacent to the phosphorescence layer and not when it is more than 5 feet away.

In another exemplary embodiment, the light emitting device may comprise a self-illuminated projectile. The self-illuminated projectile may comprise a bullet, an arrow, a rocket or a grenade. The power source may be rechargeable. The self-illuminated projectile may include an electronic circuit coupled between the power source and the light emitting diode, wherein the electronic circuit is configured to activate the light emitting diode upon an impact. The self-illuminated projectile comprises a timer electronically coupled to the light emitting diode. A launching device may be configured to project the self-illuminated projectile. The launching device may comprise a gun, a bow, a crossbow, or a rocket launcher.

In another exemplary embodiment, the light receiving device may comprise a a vest, a shirt, a shield, a jacket, an arm band, a leg band, a pair of pants or a pair of shorts.

In another exemplary embodiment, a target may include a second phosphorescence layer reactive to the 405 nanometer wavelength of light. The target may comprise a wall cling, a sticker or a stand.

An exemplary embodiment of the present invention includes a glow-in-the-dark toy kit. The kit includes a light emitting projectile configured to be projected by a projection device controlled by a first player. The light emitting projectile is configured to emit a wavelength of light from a light emitting diode powered by a power source. A light receiving device is associated with the light emitting device and configured to be worn by a second player. The light receiving device includes a phosphorescence layer reactive to the wavelength of light. The light emitting projectile and the light receiving device are used in a dark environment allowing the wavelength of light to react with the phosphorescence layer and display an imaginary or real impact when the first player uses the light emitting device to illuminate the light receiving device worn by the second player.

In another exemplary embodiment, the light emitting projectile may comprise a bullet, an arrow or a rocket and the light projection device may comprise a gun, a bow, a crossbow or a rocket launcher. The light emitting projectile may include an electronic circuit coupled between the power source and the light emitting diode, wherein the electronic circuit is configured to activate the light emitting diode upon an impact.

An exemplary embodiment of the present invention includes a glow-in-the-dark toy kit. The kit includes a light emitting device configured to be controlled by a first player. The light emitting device is configured to emit a wavelength of light from a light emitting diode powered by a power source. A light receiving device is associated with the light emitting device and configured to be worn by a second player. The light receiving device includes a phosphorescence layer reactive to the wavelength of light. The wavelength of light from the light emitting diode is configured to react with phosphorescence layer when it is substantially adjacent to the phosphorescence layer. The light emitting device and the light receiving device are used in a dark environment allowing the wavelength of light to react with the phosphorescence layer and display an imaginary or real impact when the first player uses the light emitting device to illuminate the light receiving device worn by the second player. The light emitting device may comprise a sword, a wand, a spear or a staff and the light receiving device may comprise a shield.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
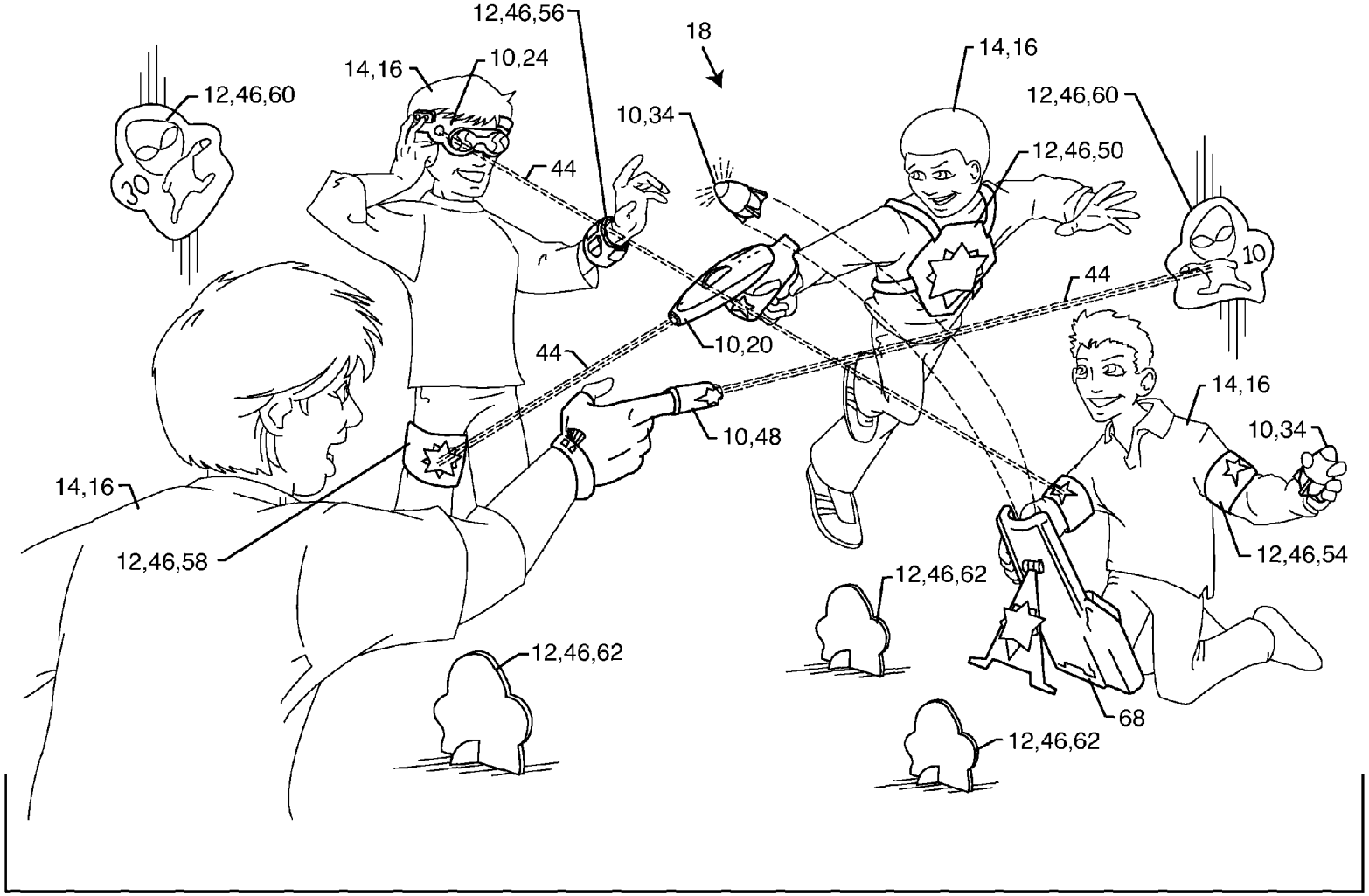
FIG. 1 is a perspective view of an exemplary glow-in-the-dark toy kit embodying the present invention.

FIG. 1 is a perspective view of a multitude of exemplary light emitting devices 10 and light receiving devices 12 embodying the present invention. When the light emitting devices 10 and light receiving devices 12 are utilized together they form the glow-in-the-dark toy kit 18. The light emitting device and the light receiving device are used in a dark environment allowing a 405 nanometer wavelength of light to react with a phosphorescence layer and display an imaginary or real impact when the first player uses the light emitting device 10 to illuminate the light receiving device 12 worn by the second player.

The light emitting devices 10 are configured to be controlled by a first player 14. The light receiving devices 12 are to be worn by a second player 16. As can be seen by one skilled in the art, a first player may also be a second player, depending on who is shooting or being shot by another player. The light emitting devices 10 can be a range of products, including a laser gun 20, a bullet 22, a pair of glasses 24, a sword 26, a grenade 28, an arrow 30, a throwing star 32, a rocket 34 or a glove 48. As can be seen by one skilled in the art, other toys such as staffs, sticks, num-chucks, sais or other toy weaponry can encompass the present invention.

Each light emitting device includes a light emitting diode (LED) 36, a power source 38 and an electronic circuit 40 controlling the LED 36 and power source 38. A switch 42 can also be coupled to the electronic circuit 40 to control the emitting of the light. The power source 38 could be a battery, a rechargeable battery or a capacitor.

The light emitting devices 10 emit a wavelength of light 44 around 405 nanometers. The range of the wavelength of light used could also be plus or minus 50 nanometers. This is a safe wavelength of light to be used for a toy. Most lasers used today are not considered or intended to be safe for toys, as the laser beam could injure the eye of the user or another. The device 10 of the present invention has a special electronic board which keeps the power of the laser within the safe Class 1 limits. The devices 10 are configured to stay at a constant power even when the power supplied might surge upwards. Therefore, the laser being projected outward is always kept at a safe level.

Figure 2:
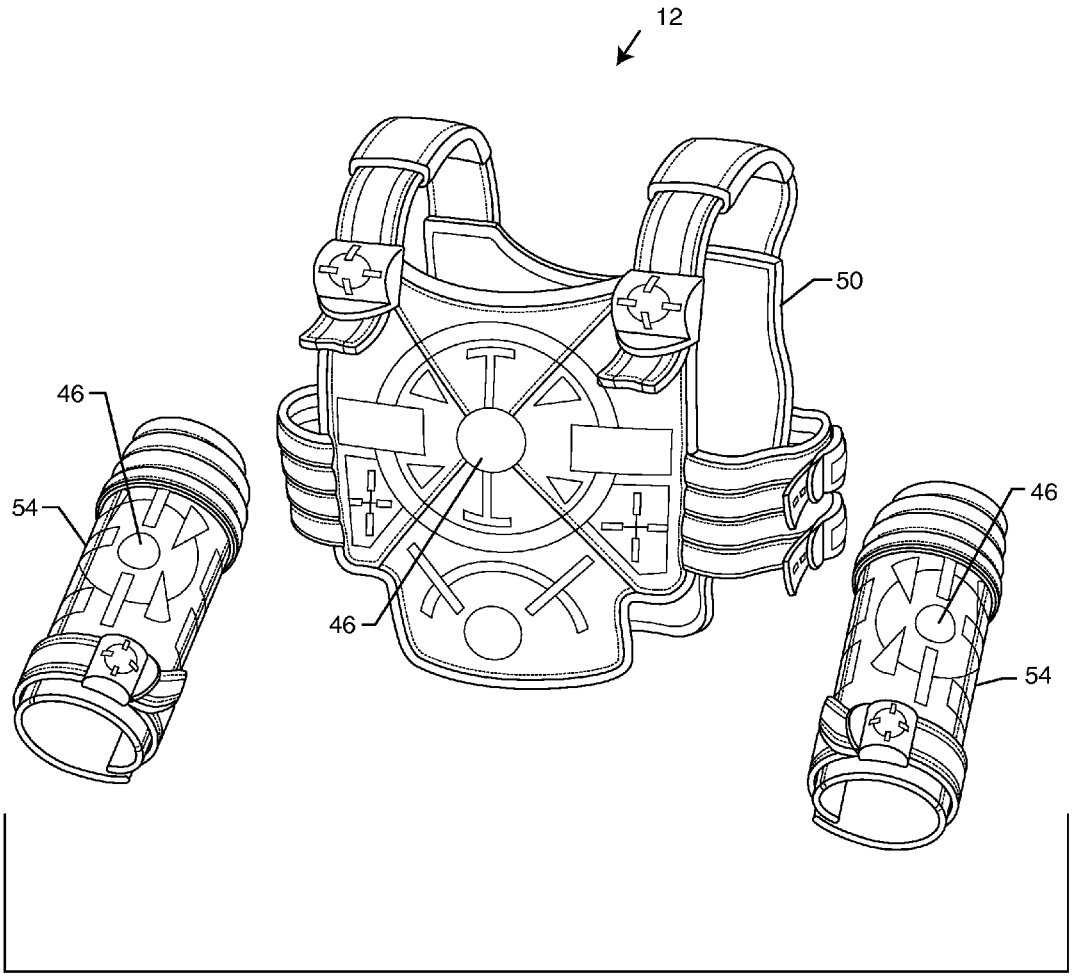
FIG. 2 is perspective view of an exemplary light receiving device in the form of a shield and arm band embodying the present invention.

The light receiving device 12 includes a phosphorescence layer 46 reactive to the 405 nanometer wavelength of light 44. As shown in FIG. 1 and now also in FIG. 2, the light receiving device can take many forms such as a vest 50, a shirt, a shield 52, a jacket, an arm band 54, a wrist band 56, a leg band 58, a pair of pants or a pair of shorts. As can be seen by one skilled in the art, the present invention can be integrated into a multitude of wearable clothing or devices.

The chemical used to create the glow-in-the-dark reaction (phosphorescence) is typically a phosphorous based chemical. Phosphorescence is a process in which energy absorbed by a substance is released relatively slowly in the form of light. This is in some cases the mechanism used for "glow-in-the-dark" materials which are "charged" by exposure to light. Unlike the relatively swift reactions in a common fluorescent tube, phosphorescent materials used for these materials absorb the energy and "store" it for a longer time as the processes required to re-emit the light occurs less often.

Phosphorescence is a specific type of photoluminescence related to fluorescence. Unlike fluorescence, a phosphorescent material does not immediately re-emit the radiation it absorbs. The slower time scales of the re-emission are associated with "forbidden" energy state transitions in quantum mechanics. As these transitions occur very slowly in certain materials, absorbed radiation may be re-emitted at a lower intensity for up to several hours after the original excitation.

Common pigments used in phosphorescent materials also include zinc sulfide and strontium aluminate. Use of zinc sulfide for safety related products dates back to the 1930s. However, the development of strontium oxide aluminate, with a luminance approximately 10 times greater than zinc sulfide, has relegated most zinc sulfide based products to the novelty category. Strontium oxide aluminate based pigments are now used in exit signs, pathway marking, and other safety related signage. It is to be understood by one skilled in the art that different types of glow-in-the-dark compositions can be used to practice the invention and therefore this disclosure is not limited to the precise forms described herein.

The light receiving device 12 can also be configured to be a stationary object that is not worn, such a wall cling 60 or a stand 62. This sticking to the wall can be accomplished through static cling or other types of removable adhesives. The wall clings 60 may also be fastened to a wall or ceiling with fasteners. Various play patterns can be used to play with such stationary light receiving devices 12 that enhance the play experience.

Figure 3:
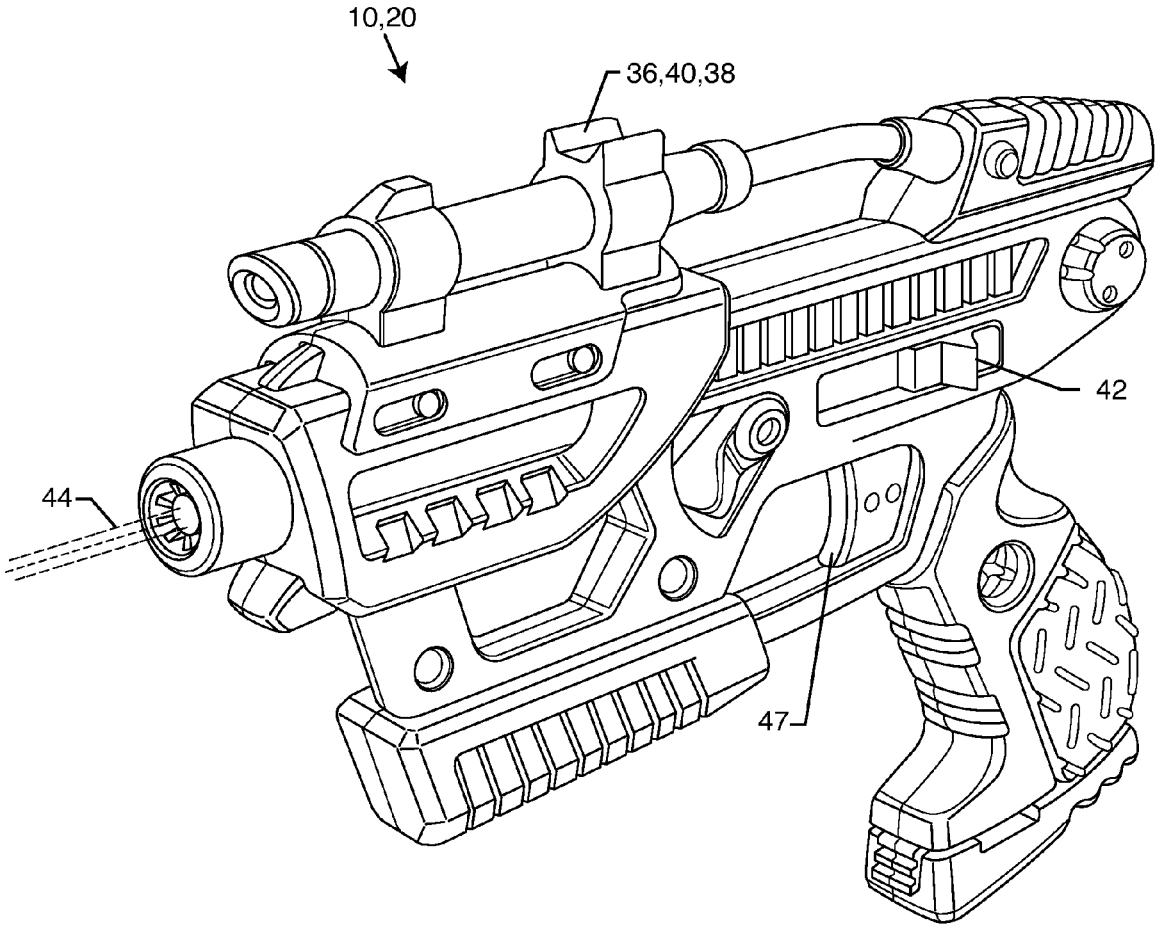
FIG. 3 is a perspective view of an exemplary light emitting device in the form of a laser gun embodying the present invention.

As shown in FIG. 3, the light emitting device 10 can be a laser gun 20. The laser gun 20 contains the light emitting diode 36, the power source 38, the electronic circuit 40, the switch 42 and a trigger 47. The trigger 47 is configured to operatively control the light emitting diode 36. In this embodiment, the laser gun 20 is configured to project the 405 nanometer wavelength of light at least 10 feet. In this way, the laser gun 20 is a long range weapon. The laser gun can take different forms, such as the pair of glasses 24 and the glove 48 best shown in FIG. 1.

Figure 4:
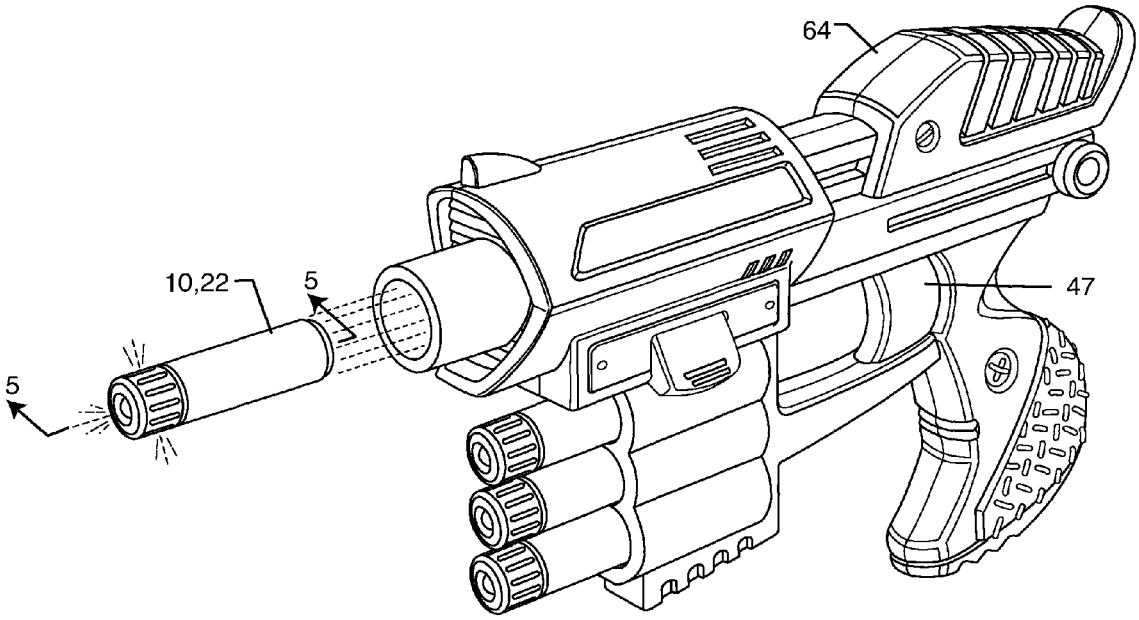
FIG. 4 is a perspective view of an exemplary light emitting device in the form of a self-illuminating projectile embodying the present invention.
Figure 5:
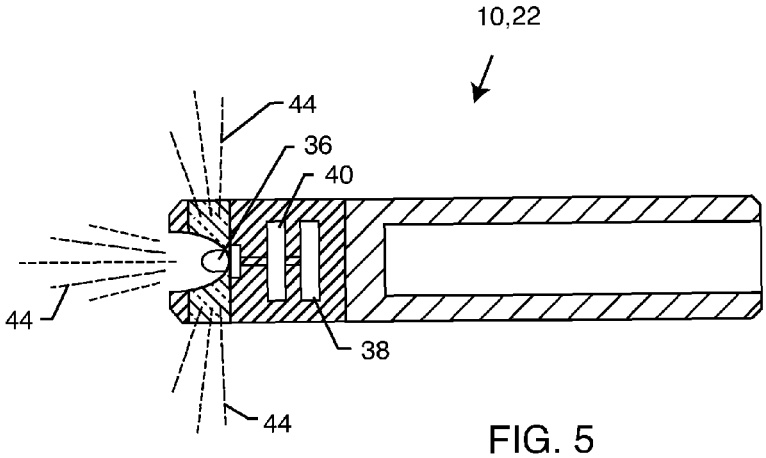
FIG. 5 is a simplified side schematic taken along lines 5-5 showing the internal structure of the bullet of FIG. 4.
Figure 6:
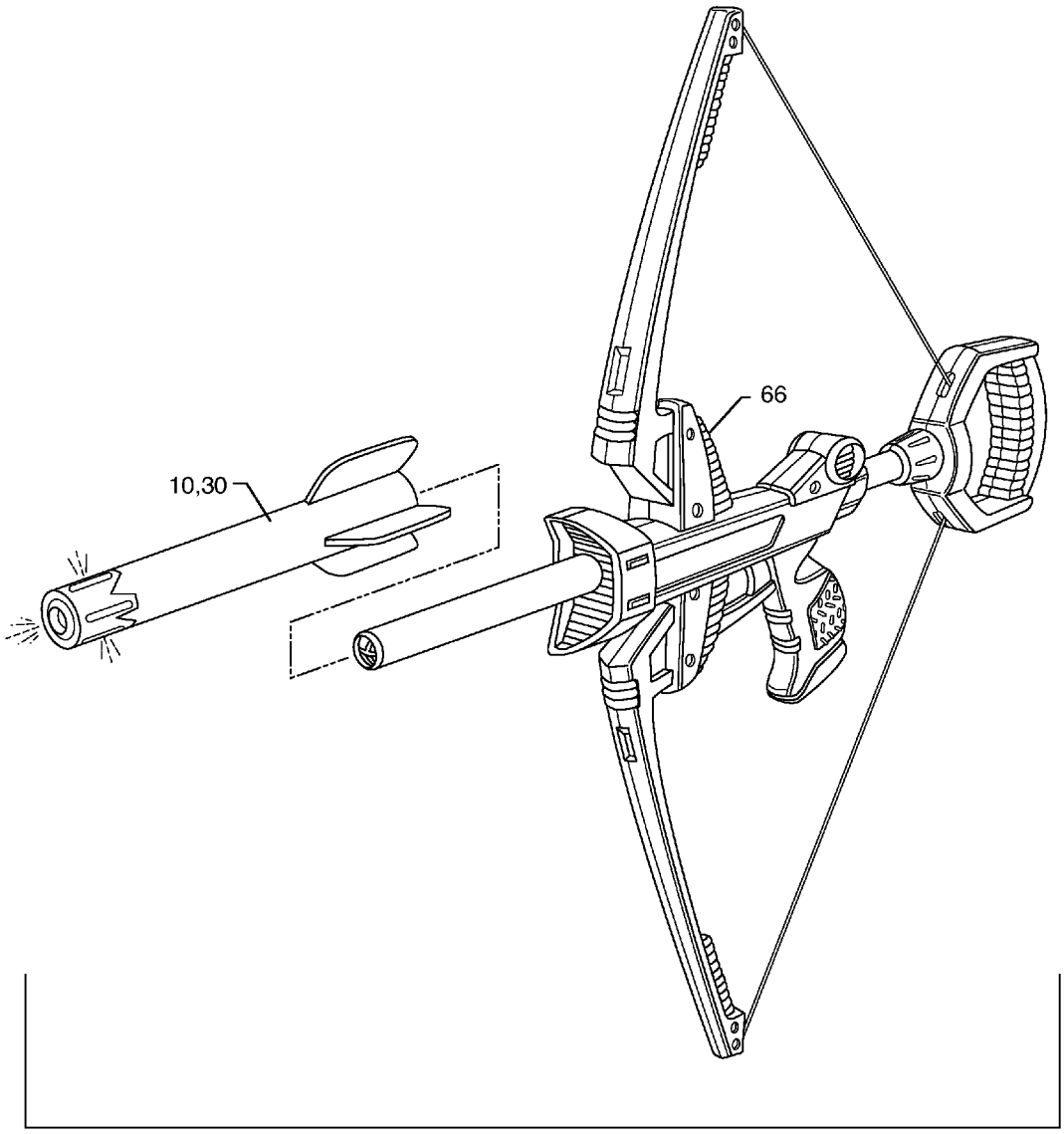
FIG. 6 is a perspective view of another exemplary light emitting device in the form of a self-illuminating projectile.

As shown in FIGS. 4, 5 and 6 the light emitting device 10 can be a self-illuminated projectile such as a bullet 22, an arrow 30 or a rocket 34. The self-illuminated projectile 10 includes the light emitting diode 36, the power source 38 and the electronic circuit 40 all packaged into a small and lightweight assembly. In this way the self-illuminated projectile may be shot from a gun 64 or a bow 66. The gun or bow may project the device 10 through a multitude of ways known in the art such as springs or compressed air. The electronic circuit 40 can be configured to control the light emitting diode 36 in a multitude of ways. The LED 36 can pulse, stay on constantly, or be configured to pulse upon impact. An accelerometer or other impact sensing device can be configured to register when the bullet 22 or arrow 30 has hit an object and then pulse the LED 36 such that it illuminates a light receiving device 12 if it had impacted one. Alternatively, the electronic circuit 40 can also include a timer that would periodically pulse the LED 36 such that it is easy to find in the dark for retrieval and reuse.

Figure 7:
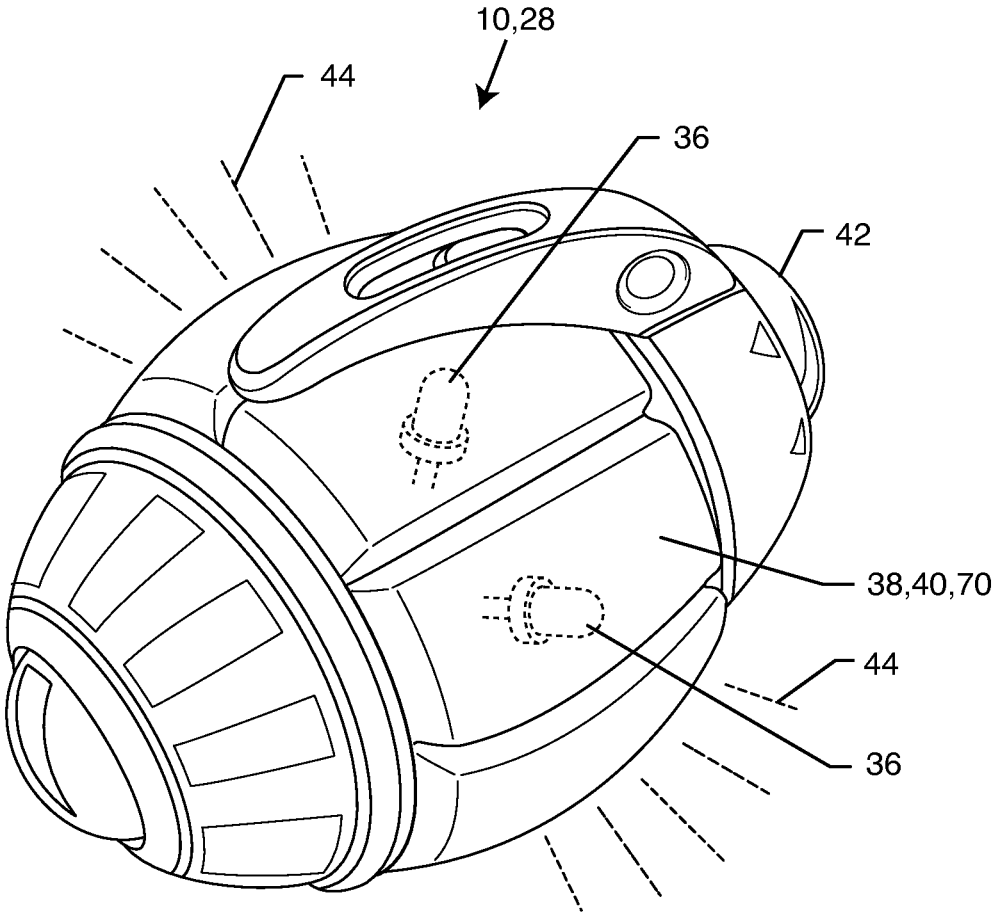
FIG. 7 is a perspective view of an exemplary light emitting device in the form of a grenade embodying the present invention.

The light emitting device 10 can also include the grenade 28 as shown in FIG. 7. The grenade 28 also includes a light emitting diode 36. However, it is preferred that a plurality of light emitting diodes 36 are used to create a bright and powerful 360 degree wave of light 44. The grenade 28 includes the switch 42, the power source 38, the electronic circuit 40 and a timer 70. In use a player would press the switch 42 and toss or roll the grenade 28 close to an opposing player. Then the timer 70 would delay the activation of the plurality of light emitting diodes 36 for a set period of time such that the grenade can travel to the opposing player. Then the light emitting diodes 36 would turn on and illuminate the light receiving device 12 of the opposing player. The grenade 28 can also include various foam or safety features such that it does not hurt or create injury if struck against a player. The light 44 in the grenade 28 can be configured to travel a long distance such as the laser gun or a shorter distance such that its range is not unlimited.

Figure 8:
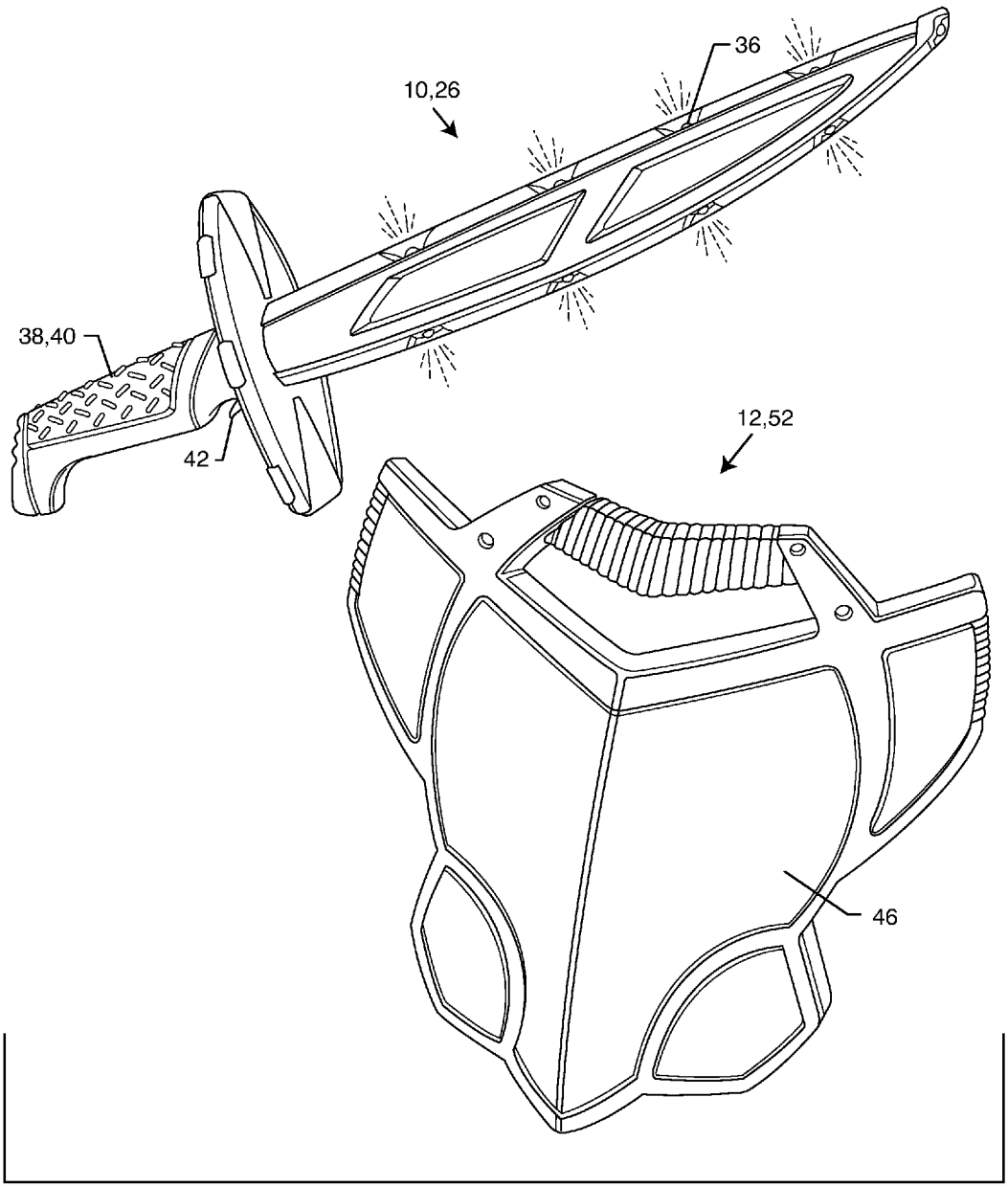
FIG. 8 is a perspective view of an exemplary light emitting sword and light receiving shield embodying the present invention.
Figure 9:
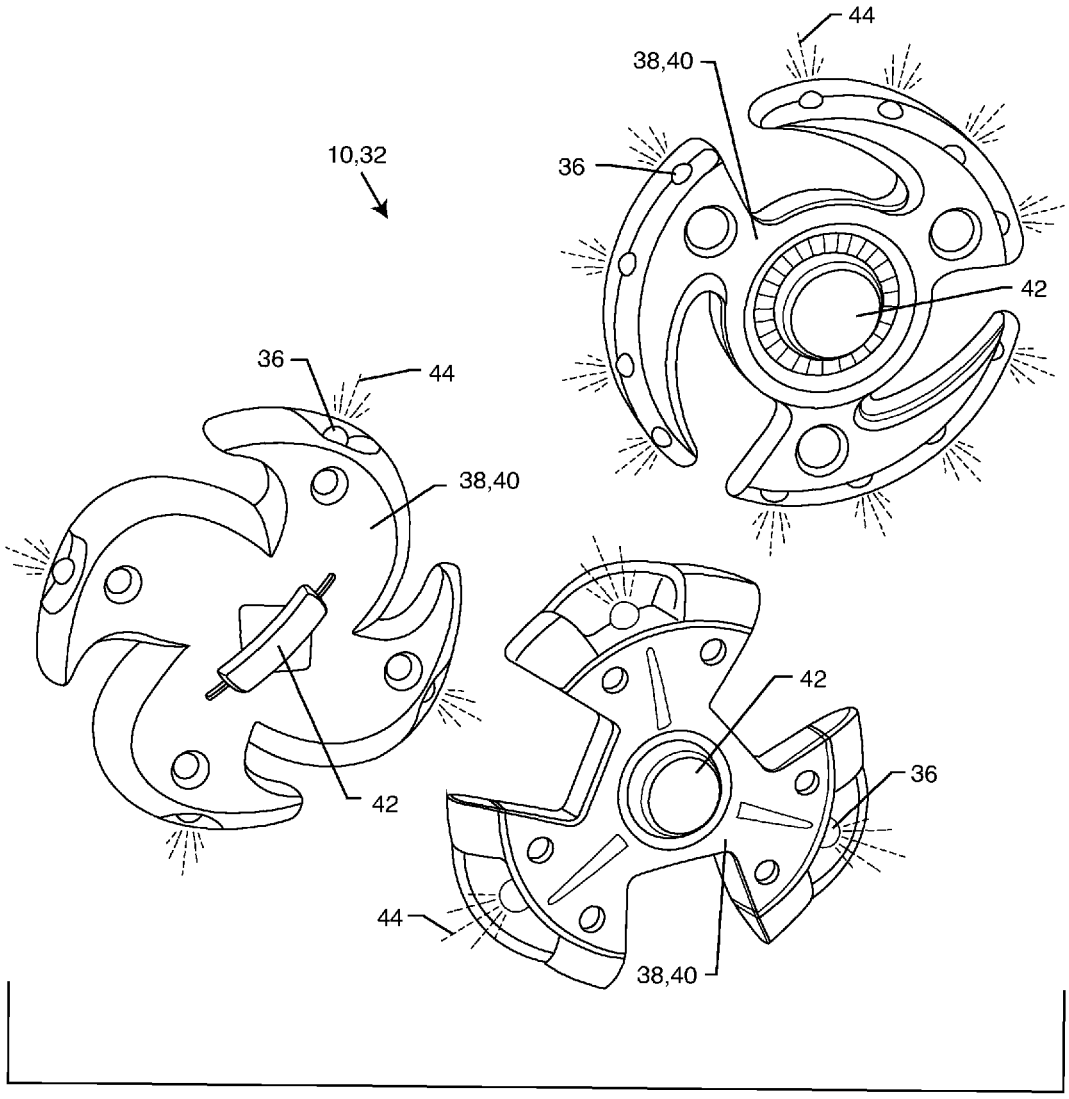
FIG. 9 is a perspective view of an exemplary set of light emitting throwing stars embodying the present invention.

The light emitting device 10 can also be configured into a short range weapon such as a sword 26 or a set of throwing stars 32 as best seen in FIGS. 8 and 9. Here, the sword 26 and throwing stars 32 would also contain the switch 42, the light emitting diode 36 or a plurality of light emitting diodes 36, the power source 38 and the electronic circuit 40. These embodiments are configured differently as compared to the long range weapons which project the laser light 44 a far distance. The light emitting diodes 36 of the short range weapons are configured to come into close proximity with the light receiving devices 12. Therefore, the 405 nanometer wavelength of light from the light emitting diode is configured to substantially react with phosphorescence layer when it is substantially adjacent to the phosphorescence layer and not when it is more than 5 feet away. In this way the sword 26 is not used in a similar manner as the laser gun 20. It is also known by those skilled in the art that other short range toy weapons can be devised such as a staff, a stick, a bat, a num-chuck, a sais, a spear or other various embodiments. All of the these embodiments may also be comprised of soft foams or light materials such that injury does not occur when one player hits another player with the light emitting devices 10.

Although several embodiments have been described in detail for purposes of illustration, various modifications may be made to each without departing from the scope and spirit of the invention. Accordingly, the invention is not to be limited, except as by the appended claims.

What is claimed is:

1. A glow-in-the-dark toy kit, comprising:

a long range light emitting device configured to be controlled by a first player, the long range light emitting device configured to emit a wavelength of light of 405 nanometers plus or minus 50 nanometers from a light emitting diode powered by a power source, wherein the long range light emitting device comprises a laser gun, a pair of glasses, or a glove including a trigger configured to operatively control the light emitting diode, wherein the first light emitting device is configured to project the wavelength of light of 405 nanometers at least 10 feet;

a light receiving device associated with the light emitting device and configured to be worn by a second player, the light receiving device comprising a phosphorescence layer reactive to the wavelength of light of 405 nanometers plus or minus 50 nanometers; and a short range light emitting device configured to be controlled by the first player, the short range light emitting device configured to emit the wavelength of light of 405 nanometers plus or minus 50 nanometers from a short range light emitting diode powered by a short range power source, wherein the short range light emitting device comprises a sword, a staff or a throwing star, wherein the wavelength of light of 405 nanometers from the short range light emitting diode is configured to react with phosphorescence layer when it is substantially adjacent to the phosphorescence layer and not when it is more than 5 feet away;

a self-illuminated projectile configured to emit the wavelength of light of 405 nanometers plus or minus 50 nanometers from a projectile light emitting diode powered by a projectile power source, wherein the projectile light emitting diode is configured to project the wavelength of light of 405 nanometers at least ten feet; and wherein the long range light emitting device, the short range light emitting device, the self-illuminated projectile and the light receiving device are used in a dark environment allowing the wavelength of light of 405 nanometers to react with the phosphorescence layer and display an imaginary or real impact when the first player uses the long range light emitting device, the short range light emitting device or the self-illuminated projectile to illuminate the light receiving device worn by the second player.

2. The kit of claim 1, including a second light emitting device configured to be controlled by the second player and a second light receiving device configured to be worn by the first player, wherein the second light emitting device is configured to also emit a wavelength of light of 405 nanometers plus or minus 50 nanometers from a second light emitting diode powered by a second power source, wherein the second light receiving device comprises a second phosphorescence layer reactive to the wavelength of light of 405 nanometers.

3. The kit of claim 1, wherein the self-illuminated projectile comprises a bullet, an arrow, a rocket or a grenade.

4. The kit of claim 1, wherein the projectile power source is rechargeable.

5. The kit of claim 1, wherein the self-illuminated projectile includes an electronic circuit electronically coupled between the projectile power source and the projectile light emitting diode, wherein the electronic circuit is configured to activate the projectile light emitting diode upon an impact.

6. The kit of claim 1, wherein the self-illuminated projectile comprises a timer electronically coupled to the projectile light emitting diode.

7. The kit of claim 1, including a launching device configured to project the self-illuminated projectile.

8. The kit of claim 7, wherein the launching device comprises a gun, a bow, a crossbow, or a rocket launcher.

9. The kit of claim 1, wherein the light receiving device comprises a vest, a shirt, a shield, a jacket, an arm band, a leg band, a pair of pants or a pair of shorts.

10. The kit of claim 1, including a target comprising a second phosphorescence layer reactive to the wavelength of light of 405 nanometers.

11. The kit of claim 10, wherein the target comprises a wall cling, a sticker or a stand.

12. A glow-in-the-dark toy kit, comprising:

a light emitting projectile configured to be projected by a projection device controlled by a first player, the light emitting projectile configured to emit a wavelength of light of 405 nanometers plus or minus 50 nanometers from a light emitting diode powered by a power source; and a light receiving device associated with the light emitting device and configured to be worn by a second player, the light receiving device comprising a phosphorescence layer reactive to the wavelength of light;

wherein the light emitting projectile includes an electronic circuit electronically coupled between the power source and the light emitting diode, wherein the electronic circuit is configured to activate the light emitting diode upon an impact;

wherein the light emitting projectile and the light receiving device are used in a dark environment allowing the wavelength of light to react with the phosphorescence layer and display an imaginary or real impact when the first player uses the light emitting device to illuminate the light receiving device worn by the second player.

13. The kit of claim 12, wherein the light emitting projectile comprises a bullet, an arrow or a rocket and the light projection device comprises a gun, a bow, a cross-bow or a rocket launcher.

14. A glow-in-the-dark toy kit, comprising:

a light emitting device configured to be controlled by a first player, the light emitting device consisting of a sword, a wand, a spear, or a staff, the light emitting device configured to emit a continuous wavelength of light of 405 nanometers plus or minus 50 nanometers from a light emitting diode powered by a power source; and a light receiving device associated with the light emitting device and configured to be worn by a second player, the light receiving device comprising a phosphorescence layer reactive to the continuous wavelength of light;

wherein the continuous wavelength of light from the light emitting diode is configured to react with phosphorescence layer when it is substantially adjacent to the phosphorescence layer and not when it is more than 5 feet away;

wherein the light emitting device and the light receiving device are used in a dark environment allowing the continuous wavelength of light when it is less than 5 feet away to react with the phosphorescence layer and display an imaginary or real impact when the first player uses the light emitting device to illuminate the light receiving device worn by the second player, such that the first and second player interact in close proximity to display the imaginary or real impact.

15. The kit of claim 14, wherein the light receiving device comprises a shield.

* * * * *